US008020572B2

(12) United States Patent
Ma

(10) Patent No.: US 8,020,572 B2
(45) Date of Patent: Sep. 20, 2011

(54) UMBRELLA STRUCTURE

(75) Inventor: Oliver Joen-an Ma, Arcadia, CA (US)

(73) Assignee: Oliver Joen-an Ma, Arcadia, CA (US)

( * ) Notice: Subject to any disclaimer, the term of this patent is extended or adjusted under 35 U.S.C. 154(b) by 85 days.

(21) Appl. No.: 12/208,299

(22) Filed: Sep. 10, 2008

(65) Prior Publication Data

US 2009/0071519 A1 Mar. 19, 2009

Related U.S. Application Data

(60) Provisional application No. 60/972,187, filed on Sep. 13, 2007.

(51) Int. Cl.
*A45B 15/00* (2006.01)
*A45B 25/18* (2006.01)

(52) U.S. Cl. ..... 135/33.41; 135/33.7; 135/15.1

(58) Field of Classification Search ..... 135/33.2, 135/33.4, 33.41, 33.7
See application file for complete search history.

(56) References Cited

U.S. PATENT DOCUMENTS 212,457 A 2/1879 Girbardt
312,446 A 2/1885 Drake
617,415 A 1/1899 Eatman
2,923,449 A * 2/1960 Sund ..... 223/69
3,850,187 A * 11/1974 Haisler ..... 135/25.3
3,885,582 A 5/1975 Kowalski
3,889,698 A 6/1975 Roessl
4,505,285 A 3/1985 French
5,020,557 A 6/1991 Apple
5,078,166 A 1/1992 Lee
5,355,903 A 10/1994 Haddad et al.
5,482,069 A 1/1996 Lee
5,640,984 A 6/1997 Dubunsky
5,678,586 A 10/1997 Baksh
5,749,386 A 5/1998 Samuel, Jr.
5,850,843 A 12/1998 Mahood et al.
5,865,201 A 2/1999 Lin
6,039,063 A 3/2000 Lin et al.
6,397,867 B2 6/2002 You
6,502,592 B2 * 1/2003 Chen ..... 135/33.7
6,681,784 B2 * 1/2004 Chou et al. ..... 135/33.7
2003/0098050 A1 5/2003 Lee
2004/0149327 A1 * 8/2004 You ..... 135/33.7
2004/0211452 A1 * 10/2004 Wu ..... 135/33.7
2008/0115815 A1 * 5/2008 Awni ..... 135/33.7

* cited by examiner

*Primary Examiner* — David Dunn
*Assistant Examiner* — Danielle Jackson
(74) *Attorney, Agent, or Firm* — Knobbe Martens Olson & Bear, LLP

(57) ABSTRACT

An umbrella is provided that comprises a canopy and a support structure upon which the canopy is supported. The canopy can comprise a first panel and a second panel. The support structure can comprise a spacer configured to provide a gap separating the first and second panels to permit air to be vented through the canopy.

29 Claims, 10 Drawing Sheets

UMBRELLA STRUCTURE

CROSS-REFERENCE TO RELATED APPLICATIONS

This application claims the benefit of U.S. Provisional Application No. 60/972,187, filed Sep. 13, 2007, the entirety of which is incorporated herein by reference.

BACKGROUND

1. Field

This application concerns shade structures, such as umbrellas, particularly large free-standing umbrellas that have a canopy. In some embodiments, the canopy can comprise a plurality of sections that can separated by a spacer to create a gap intermediate two adjacent portions of the canopy.

2. Description of the Related Art

Shade structures, and in particular umbrellas, have long been known that comprise a pole supporting a set of ribs to which is attached a fabric canopy and having a mechanism mounted to the pole that extends or retracts the ribs to or lower the canopy.

As use of outdoor restaurants, patios and gardens and the like becomes more popular, there is an increasing demand for shade structures that are more flexible, visually appealing or that offer enhanced features or ease of operation.

SUMMARY

An umbrella is provided that comprises a canopy and a support structure upon which the canopy is supported. The canopy comprises a first panel and a second panel. The umbrella can comprise a spacer configured to provide a gap separating the first and second panels. The spacer can be coupled to or otherwise be a part of the support structure. In some embodiments, the gap between the panels provided by the spacer permits air to be vented across the canopy.

In one embodiment, the spacer can be disposed on, e.g., mounted to, a top side of a rib near a bottom edge of the first panel. Further, the spacer can be mounted to a top side of a rib and can be biased away from the rib. The spacer can also be biased to provide the gap at least when the umbrella is in the open position.

The spacer can be movable from a first position in which the first panel is separated from the second panel by a first distance to a second position in which the first panel is separated from the second panel by a second distance greater than the first distance. In this regard, the spacer can be in the second position in the absence of a force exceeding the weight of the first panel. Additionally, the spacer can move toward the first position in response to a load exceeding the weight of the first panel.

The spacer can include an elongate member comprising a first end and a second end, wherein the first end is coupled with a rib of the support structure and the second end is moveable from a first position to a second position. In some embodiments, the first position is between the second position and a surface of the rib. The spacer can be pivotable relative to the rib. For example, in some embodiments a bracket can interconnect the spacer and the rib. In some embodiments, the umbrella can further comprise a resilient member configured to bias the elongate member toward the second position.

Additionally, a fixture for connecting a first canopy panel and a second canopy panel to a support structure of an umbrella is provided. The support structure can include a rib.

The fixture can comprise a bracket, an elongate member, an attachment mechanism, and a coupling mechanism. The bracket can have a rib mounting surface configured to be coupled with the rib. The elongate member can have a first end and a second end. The first end can be pivotally coupled with the bracket and the second end can be moveable relative to the bracket. The second end can have a panel engagement surface facing away from the bracket. The panel engagement surface can be capable of applying a force to the first panel.

The attachment mechanism can be operative to attach the elongate member to the bracket such that at least the panel engagement surface is separated from a plane extending along the rib mounting surface. The coupling mechanism can couple an upper portion of the second canopy panel to the rib.

In some embodiments, the fixture can further include a biasing means that biases the elongate member relative to the bracket such that at least the panel engagement surface is separated from a plane extending along the rib mounting surface. In such an embodiment, the biasing means can include a spring or any other resilient member, such as those disclosed herein.

The coupling means can include a slot. The slot can include a u-shaped channel configured to receive an engagement member or portion of a panel. The engagement member or portion of the panel can include a rivet or button fastener that can be coupled with an upper portion of the second canopy panel.

The bracket can include an elongate portion including the coupling means. The bracket can include a flange for coupling the fixture to a side surface of a rib of the support structure.

An embodiment of the invention provides an umbrella comprising a support pole having a top; a plurality of ribs extending from adjacent the top of the pole, the ribs having free ends and being movable to open and close the umbrella; a canopy, formed by a plurality of panels, the panels having gaps between them and between at lease one pair of adjacent ribs, so as to form a series of such gaps in the direction from the top of the pole to the free ends of the ribs; a plurality of spacers mounted to at least some of the ribs, the spacers being configured to bear against the panels when the umbrella is open, so as to open the gaps and allow air to flow through the umbrella. The spacers may be mounted to each rib. The number of spacers on each rib may correspond to the number of gaps. The spacers may comprise a mechanism for attaching the panels. The spacers may be biased away from the ribs.

In an embodiment, the gaps may extend substantially the distance between adjacent ribs. There may be 2, 3, 4 or 5 gaps between each pair of adjacent ribs.

An embodiment on the invention provides a method of venting an umbrella, which comprises a plurality of ribs supporting a canopy, the method comprising providing a plurality of gaps in the canopy extending substantially horizontally, when the umbrella is open, between at least one pair of adjacent ribs and located along the at least one pair of adjacent ribs, and providing a plurality of spacers mounted on the at least one pair of adjacent ribs to open the gaps when the umbrella is on use.

BRIEF DESCRIPTION OF THE DRAWINGS

The abovementioned and other features of the inventions disclosed herein are described below with reference to the drawings of some preferred embodiments. The illustrated embodiments are intended to illustrate, but not to limit the invention. The drawings contain the following figures.

DETAILED DESCRIPTION OF THE PREFERRED EMBODIMENTS

Figure 1:
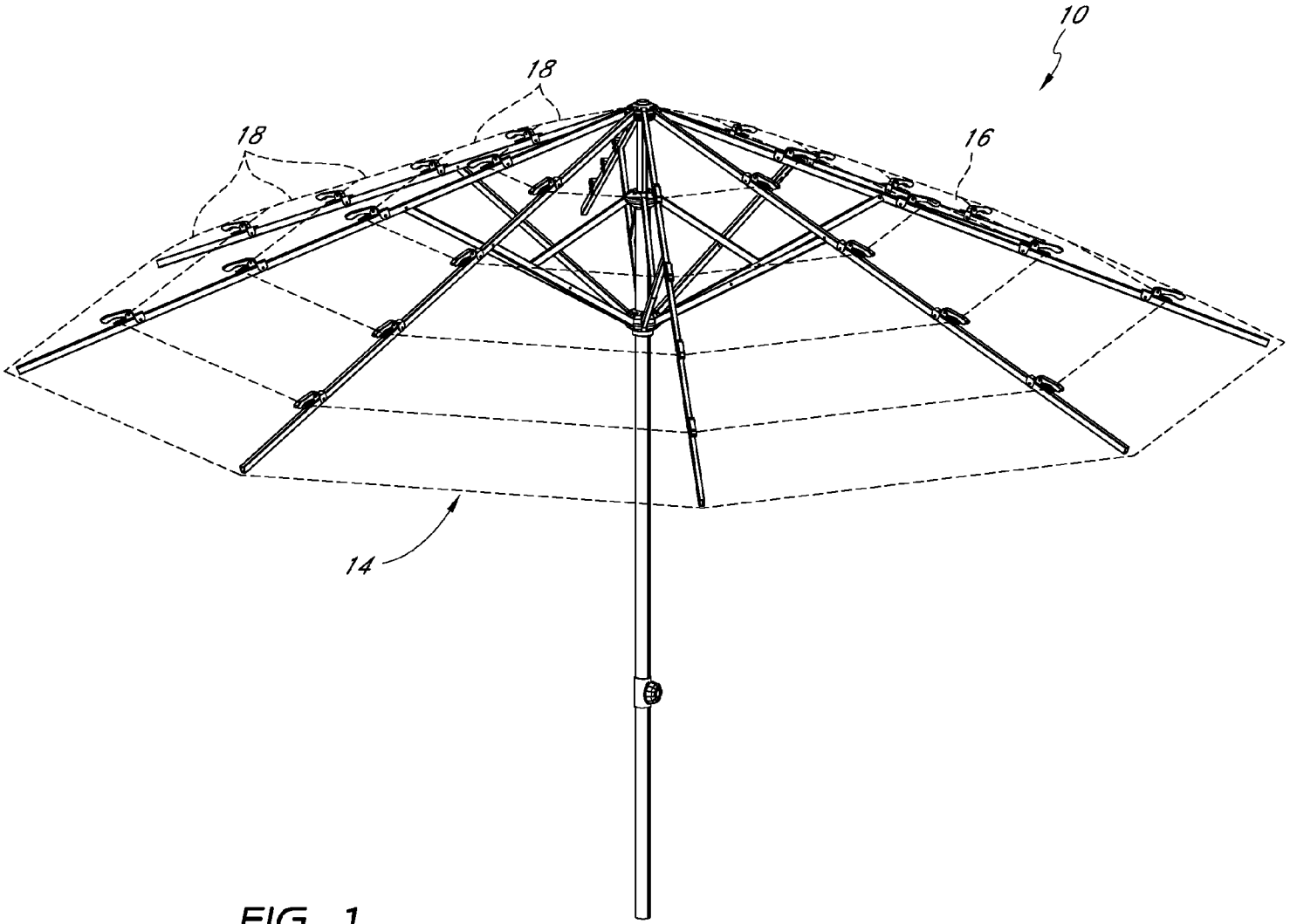
FIG. 1 is a perspective view of an umbrella according to an embodiment.

Referring now to the drawings, which illustrate some preferred embodiments of the present inventions, and not for limiting the same, a uniquely configured umbrella 10 is provided. As will be described in greater detail herein, the umbrella 10 can be adjusted between a closed position 12, shown in FIG. 2A and an open position 14, shown in FIG. 2C. In some embodiments, the umbrella 10 can incorporate innovative mechanisms that tend to reduce and/or eliminate the likelihood of damage to the umbrella or its canopy when substantial forces are exerted thereon, such as due to wind, or falling objects.

FIGS. 1-8 illustrate some umbrellas and umbrella structures that can be used with the embodiments described herein, but it will be understood that these umbrellas and umbrella structures can be variously modified and that the embodiments discussed herein can still be used therewith.

Figure 2A:
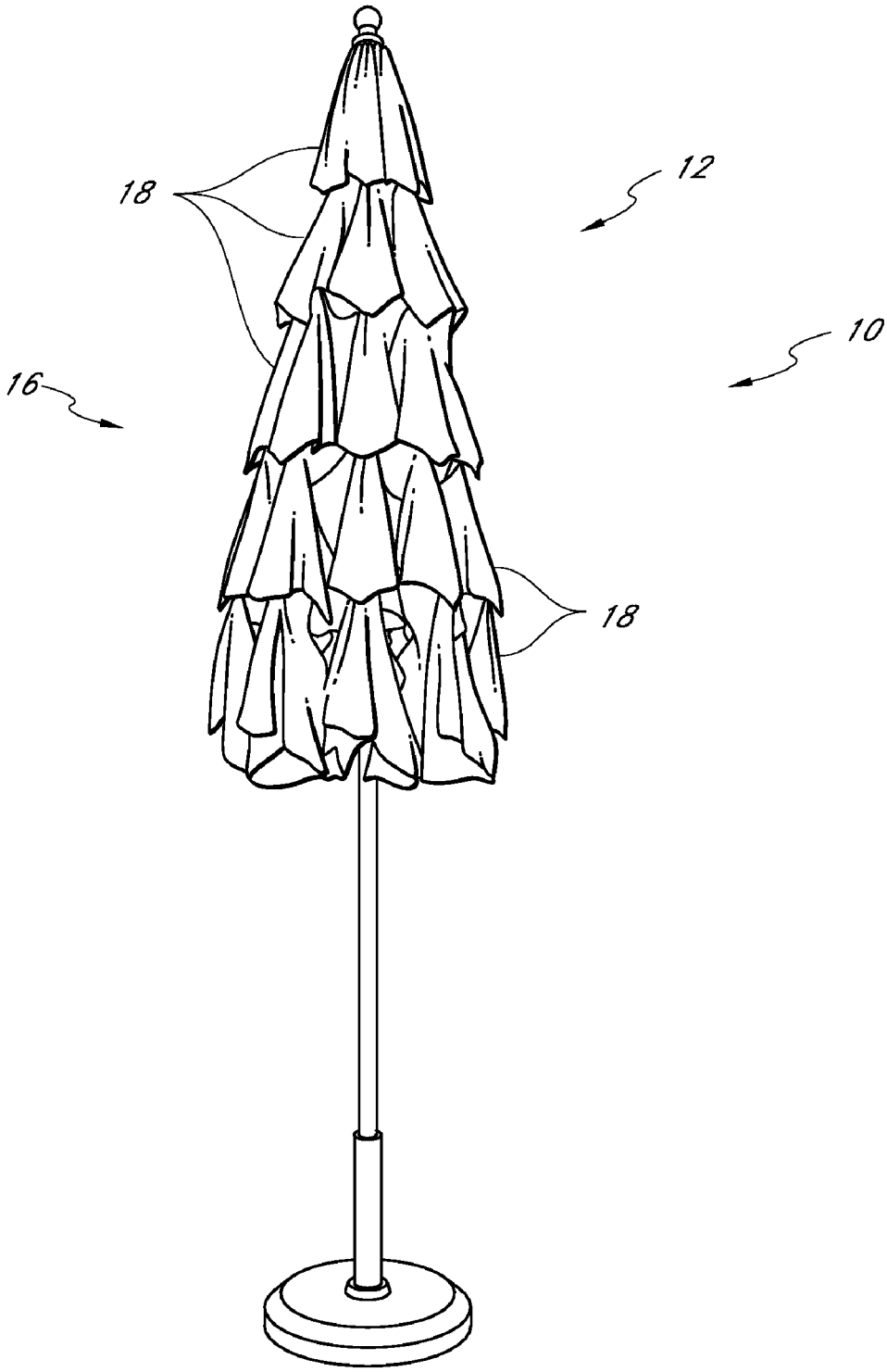
FIG. 2A is a perspective view of the umbrella shown in FIG. 1 in an unopened position.
Figure 2B:
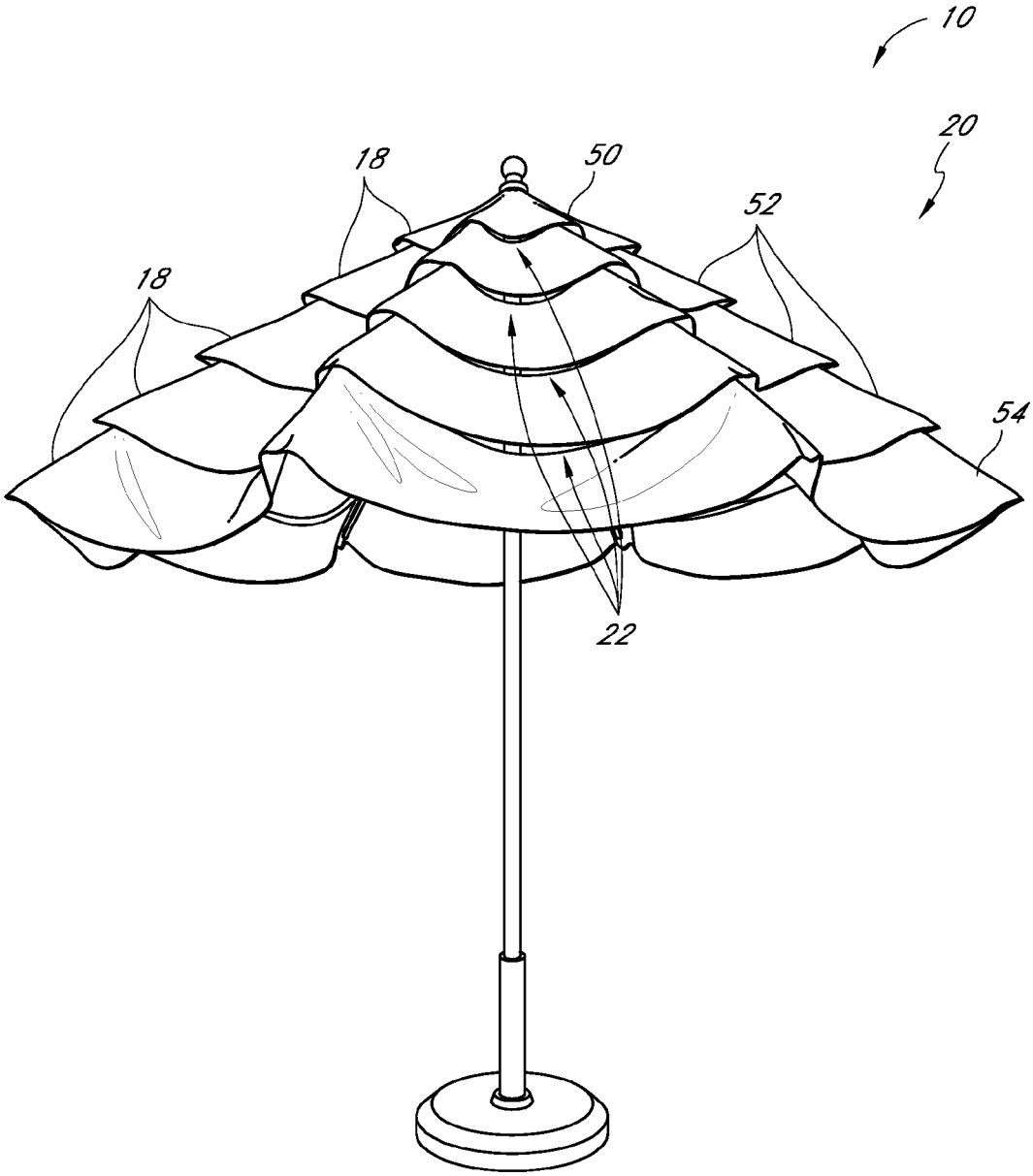
FIG. 2B is a perspective view of the umbrella shown in FIG. 1 in a semi-open position.
Figure 2C:
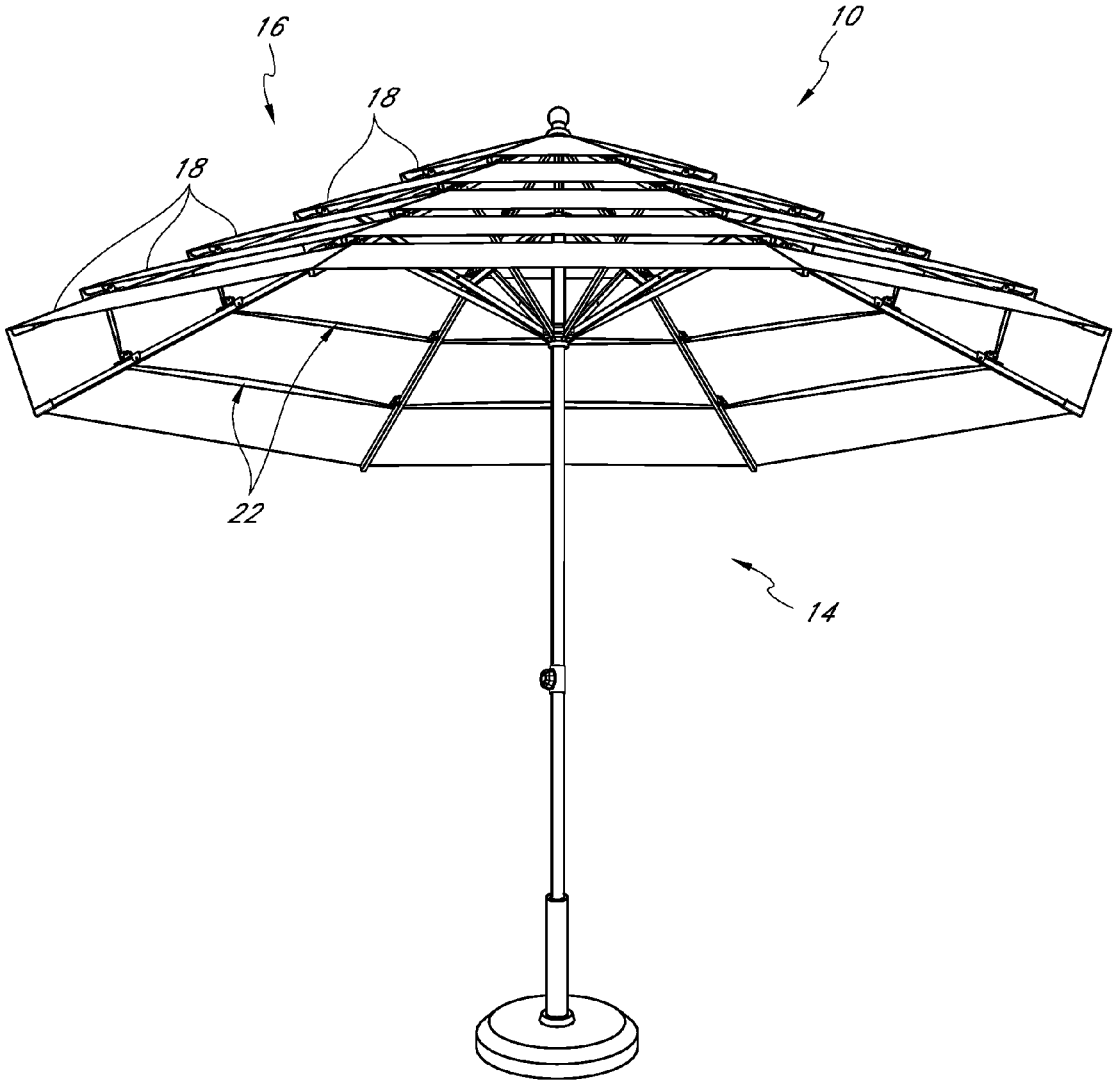
FIG. 2C is a perspective view of the umbrella shown in FIG. 1 in an open position.

Referring now to FIG. 1, the umbrella 10 is shown in a substantially open position 14 (also shown in FIG. 2C). A canopy 16 is shown in dashed lines. As illustrated therein, the canopy 16 can include a plurality of panels 18. The embodiment of FIG. 1 includes five panels 18. In some embodiments fewer panels are provided, for example as few as one or two panels. In some embodiments, the panels 18 can be separately formed. Accordingly, each panel 18 can attach to the umbrella 10 independently of the other panels 18. The panels 18 can be attached to the umbrella 10 in such a way as to allow air to be vented through the canopy 16, as described in greater detail below. In this regard, embodiments disclosed herein can facilitate the spacing and/or connection of the panels 18 to the umbrella 10.

Referring now to FIG. 2A, the umbrella 10 is shown in the closed position 12. When in the closed position 12, the umbrella 10 can be configured such that the panels 18 tend to sag with substantial gaps intermediate the panels, thereby venting air through the canopy 16. As will be appreciated, this structure can tend to minimize and/or prevent damage to the umbrella 10 or the canopy 16 due to wind loads. For example, on a windy day, the umbrella can be in the closed position 12 and wind can easily pass through the panels 18 of the canopy 16 without creating a significant amount of drag on the canopy 16 and the umbrella 10. Thus, the umbrella 10 will not be damaged by strong gusts of wind.

As mentioned above, the umbrella 10 can move from the closed position 12 towards the open position 14 through actuation of the umbrella 10. As shown in FIG. 2B, an intermediate position 20 occurs with the panels 18 being generally loose on the umbrella 10. As the umbrella 10 extends towards the open position 14, as shown in FIG. 2C, the panels 18 become more taut. As illustrated, this configuration provides an aesthetically pleasing appearance of the umbrella.

FIGS. 2B and 2C also illustrate that as the umbrella 10 is opened, gaps 22 extend between the panels 18 of the canopy 16. The gaps 22 can extend substantially all the way around the canopy 16 at a plurality of elevations thereby providing the canopy 16 with a venting feature.

Figure 3:
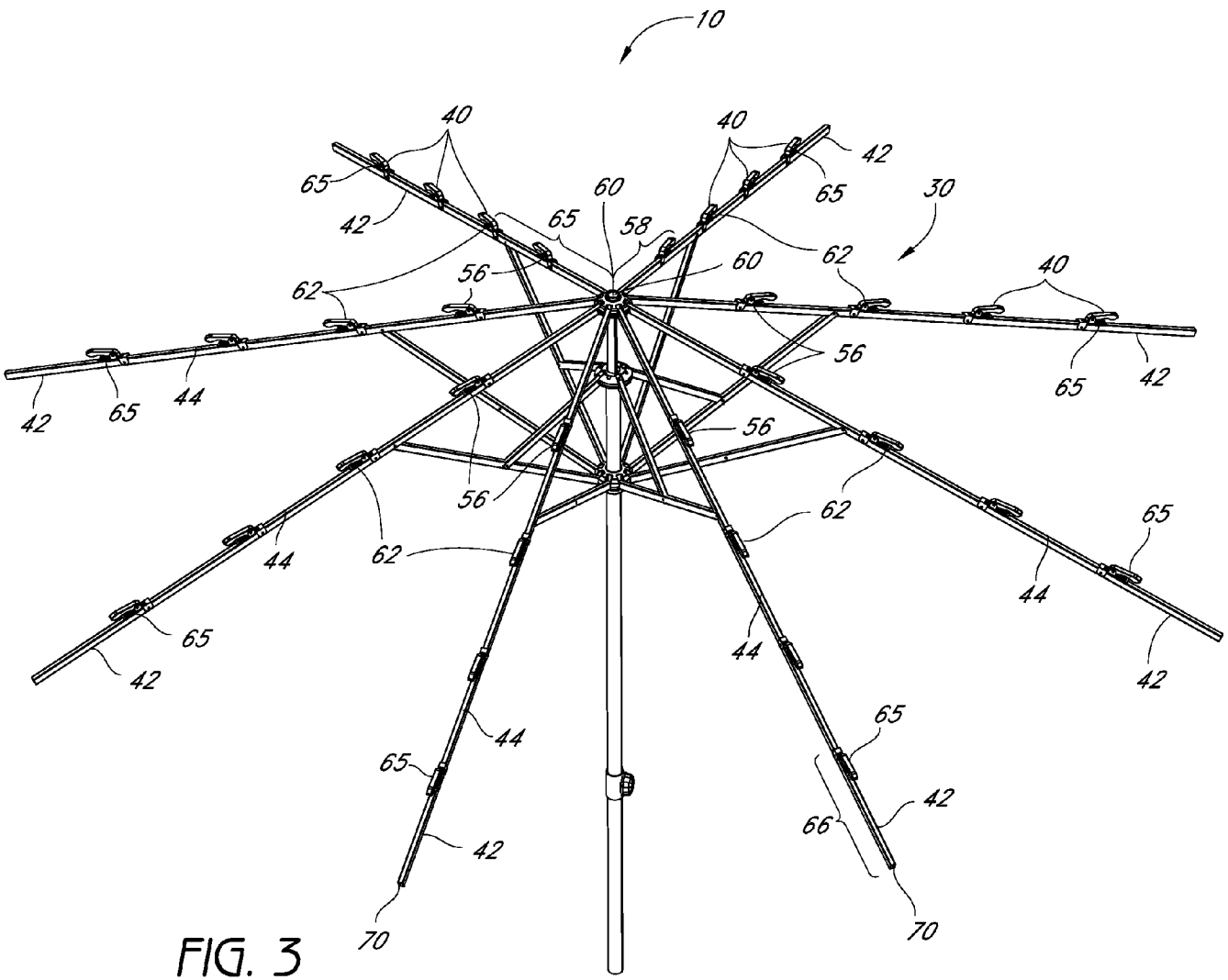
FIG. 3 is a top perspective view of a canopy support frame of the umbrella illustrated in FIG. 1, wherein the canopy support frame includes a plurality of spacers.

FIG. 3 is a top perspective view of the umbrella 10 illustrating a canopy support frame 30 of the umbrella 10 and a plurality of spacer assemblies 40 attached to the canopy support frame 30. FIG. 3 illustrates a plurality of hubs that can translate along a support pole assembly. Configurations of the umbrella 10, including the hubs and support pole assembly are also described in Applicant's United States Patent Application Publication No. 2006/0090784, titled Umbrella Opening and Closing Device, filed on Aug. 31, 2006; U.S. patent application Ser. No. 11/850,628, titled Shade Structures Such As Umbrellas, filed on Sep. 5, 2007; and U.S. patent application Ser. No. 11/850,640, titled Hubs For Shade Structures, filed on Sep. 5, 2007, the disclosures of which are hereby incorporated by reference in their entirety.

The spacer assemblies 40 can be disposed on, e.g., coupled to, at least one rib member 42 of the canopy support frame 30. In one embodiment, the spacer assemblies 40 are attached to an upper surface 44 of the rib member 42. The spacer assemblies 40 can be attached to the rib members 42 at any position therealong and to any surface thereof. In one embodiment, the spacer assemblies 40 are attached to the rib members 42 such that the spacer assemblies 40 extend outwardly from the canopy support frame 30. In such an embodiment, the spacer assemblies 40 can thereby engage and support the panels 18 of the canopy 16 and also space the panels from the rib members 42.

As also illustrated in FIG. 3, it is contemplated that a plurality of spacer assemblies 40 can be coupled to each rib members 42. The number and spacing of the spacer assemblies 40 on each of the rib members 42 can be varied as desired. Furthermore, it is contemplated that in some embodiments, a plurality of spacer assemblies 40 is coupled to each rib members 42. For example, each rib members 42 can include a spacer assembly 40 designated for a given panel 18 of the canopy 16. Therefore, as illustrated in FIG. 3, four spacer assemblies 40 can be provided on each rib members 42 to allow a corresponding number of panels 18 to be engaged and supported thereby. Referring again to FIG. 2B, the spacer assemblies 40 can support a crown panel 50, a plurality of intermediate panels 52, and a base panel 54.

As shown in FIGS. 2B and 3, the panels 18 of the canopy 16 can be configured to generally overlap one another when coupled to the canopy support frame 30. For example, the crown panel 50 can be configured to generally overlap with the adjacent intermediate panel 52 in such a way as to prevent the ingress of sunlight or rain when the umbrella 10 is in the open position 14. The degree of overlap can be generally manipulated by altering the configuration of the spacer assemblies 40, as described further herein.

As also discussed further herein, the spacer assemblies 40 can be used to engage and to support a lower portion of an upper panel (e.g., the crown panel 50) and an upper portion of a lower panel (e.g., an intermediate panel 52). For example, as shown in FIG. 3, a first series of spacer assemblies 56 can be mounted onto the canopy support frame 30 at a first distance 58 from an apex 60 of the canopy support frame 30. Each of the spacer assemblies 40 of the first series 56 can be used to attach or secure both the crown panel 50 and the adjacent intermediate panel 52 to the canopy support frame 30.

In a similar manner, a second series 62 of spacer assemblies 40 can also be mounted to the support frame 30 at a second distance 64 from the apex 60 of the canopy support frame 30. Similar to the first series 56 of spacer assemblies 40, the second series 62 of the spacer assemblies 40 can be used to couple a lower portion of an intermediate panel 52 and an upper portion of an adjacent intermediate panel 52 to the canopy support frame 30. Accordingly, the size of the panels 18 is related to the spacing of each series of spacer assemblies 40 used on the canopy support frame 30.

Figure 4A:
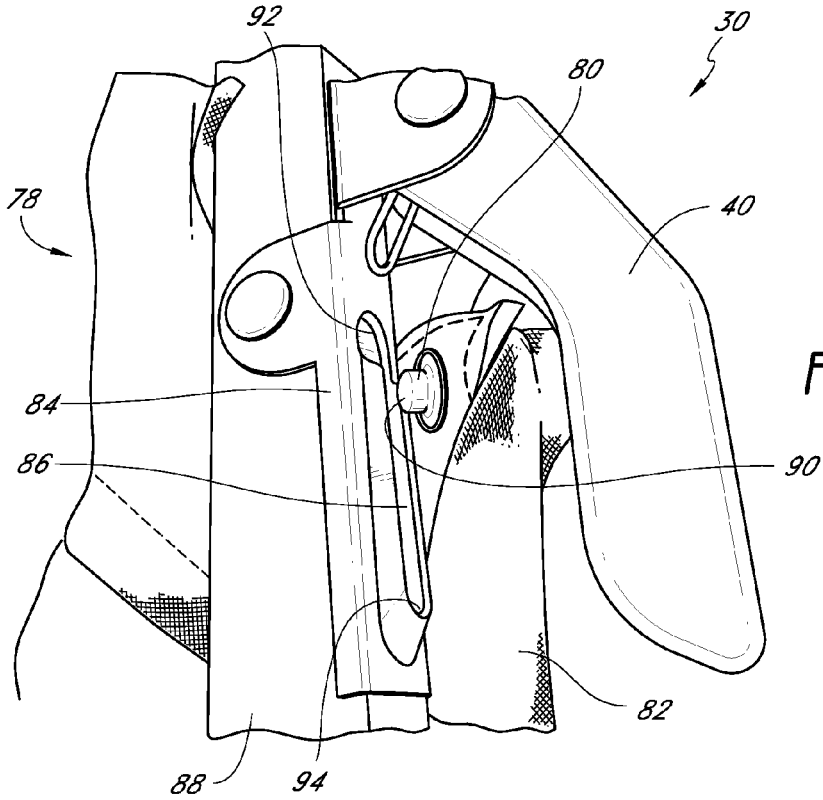
FIG. 4A is a perspective view of a spacer assembly and a canopy attachment portion wherein the canopy attachment portion is being coupled to the spacer assembly, in accordance with an embodiment.
Figure 4B:
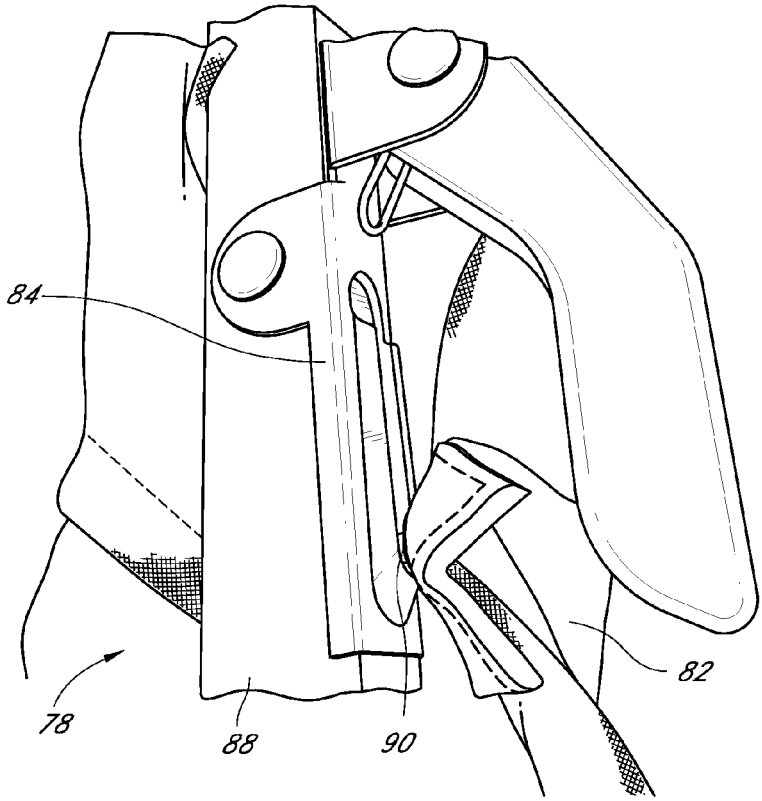
FIG. 4B is a perspective view of the spacer assembly and canopy attachment portion of FIG. 4A wherein the canopy attachment portion has been coupled to the spacer assembly, in accordance with an embodiment.

Referring now to FIGS. 4A-B, a coupling mechanism 80 of the umbrella 10 is shown. The coupling mechanism 80 can be used to attach or couple the panels 18 to the canopy support frame 30. As illustrated, the coupling mechanism 80 can be attached to a lower canopy panel 82. Accordingly, as shown in FIGS. 4A-B, the coupling mechanism 80 can be used with a spacer assembly 40 to thereby couple at least a portion of the lower canopy panel 82 to the spacer assembly 40. In the illustrated embodiment, the spacer assembly 40 can include a bracket 84 that can be mounted onto a rib member 88 of the canopy support frame 30. The bracket 84 can include a slot 86 that extends along the bracket 84.

In some embodiments, the coupling mechanism 80 can be attached to the spacer assembly 40 by slidably mounting to within the slot 86. For example, the coupling mechanism 80 can include a protuberance or engaging portion 90, such as a rivet, that is received within an open end 92 of the slot 86. As shown in FIG. 4B, the open end 92 has a width that is enlarged compared to the width of the slot 86 adjacent to the open end 92. This enlargement permits the engaging portion 90 to be received in to the open end 92 and to slide down the slot 86. The coupling mechanism 80 can then pass along the slot 86 towards a closed end 94 thereof into a final position, as shown in FIG. 4B. Accordingly, the lower panel 82 can then be firmly secured to the spacer assembly 40. Nevertheless, it is contemplated that other coupling mechanisms can be utilized to couple the lower panel 82 to the spacer assembly 40. For example, buttons or snaps of various kinds could be used to attach the lower panel 82 at a location corresponding to the closed end 94 of the slot 86.

In embodiments wherein the canopy 16 generally defines a right circular cone, the slant height of one of the panels 18 can generally correspond to the distance intermediate adjacent series of spacer assemblies 40 along the rib members 42. The slant height of the crown panel 50 can be generally equal to the first distance 58, which is the distance between the apex 60 and the first series 56 of spacer assemblies 40.

Further, the slant height of the intermediate panel 52 adjacent the crown panel 50 will generally be the difference between the first distance 58 and the second distance 64, thus representing the distance between the first series 56 of spacer assemblies and the second series 62 of the spacer assemblies 40. This general geometric relationship can be present for each of the series of spacer assemblies 40 and the panels 18. Although generally illustrated as having panels of equal width or slant height, in other embodiments some of the panels are wider than others. For example, a first intermediate panel could be twice as wide as other, lower intermediate panels.

In some embodiments, a base series 64 of the spacer assemblies 40 can be spaced at a base distance 66 from an end 70 of the rib members 42. As will be appreciated with reference to the discussion below, the ends 70 of the rib members 42 can include a spring loaded section that allows the ends 70 to be pushed towards the apex 60 of the canopy support frame 30. In this manner, the base panel 54 can be coupled to the base series 64 of spacer assemblies 40 and to the ends 70 of the rib members 42 with the ends 70 being operative to move from a retracted position to an extended position in order to facilitate the engagement of the ends 70 with a lower portion of the base panel 54.

Figure 5:
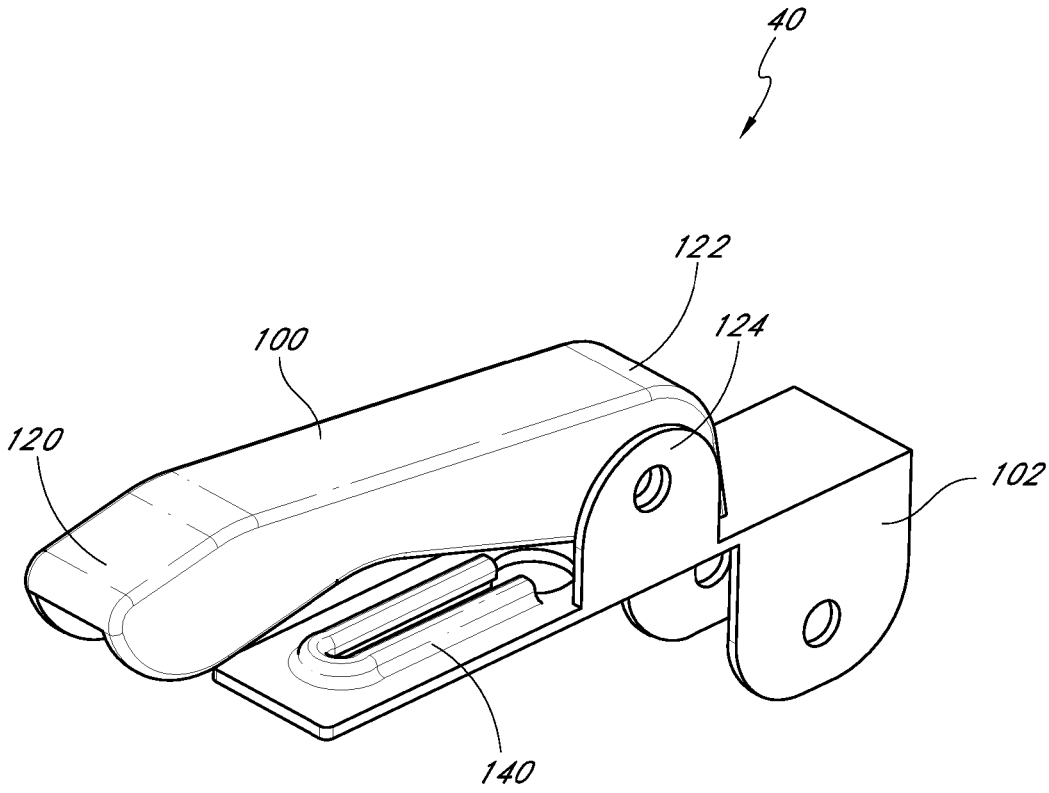
FIG. 5 is a perspective view of a spacer assembly in accordance with another embodiment.
Figure 6:
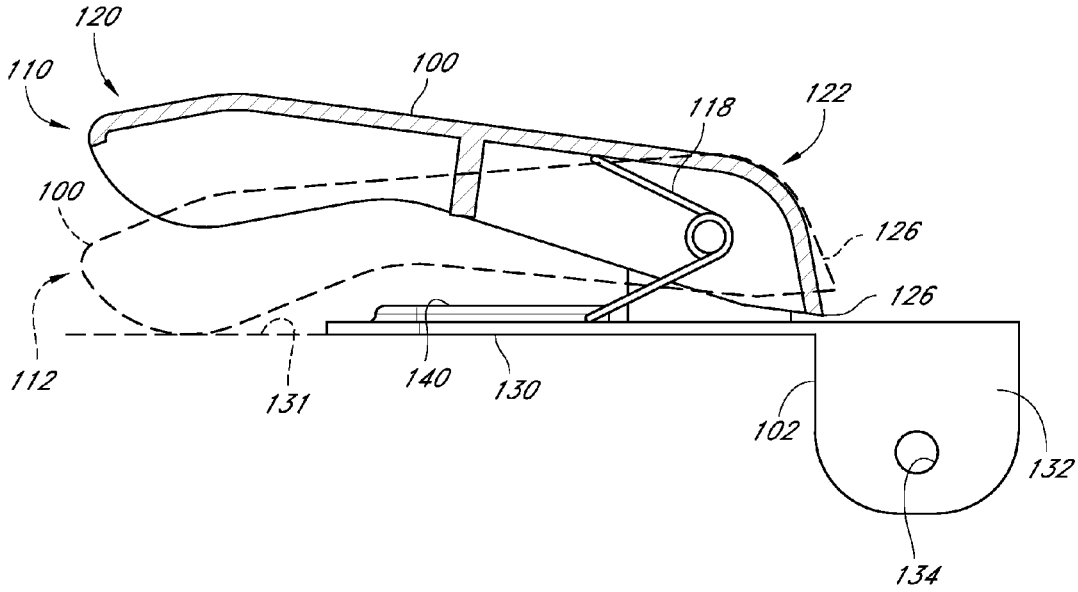
FIG. 6 is a side view of the spacer assembly shown in FIG. 5.
Figure 7:
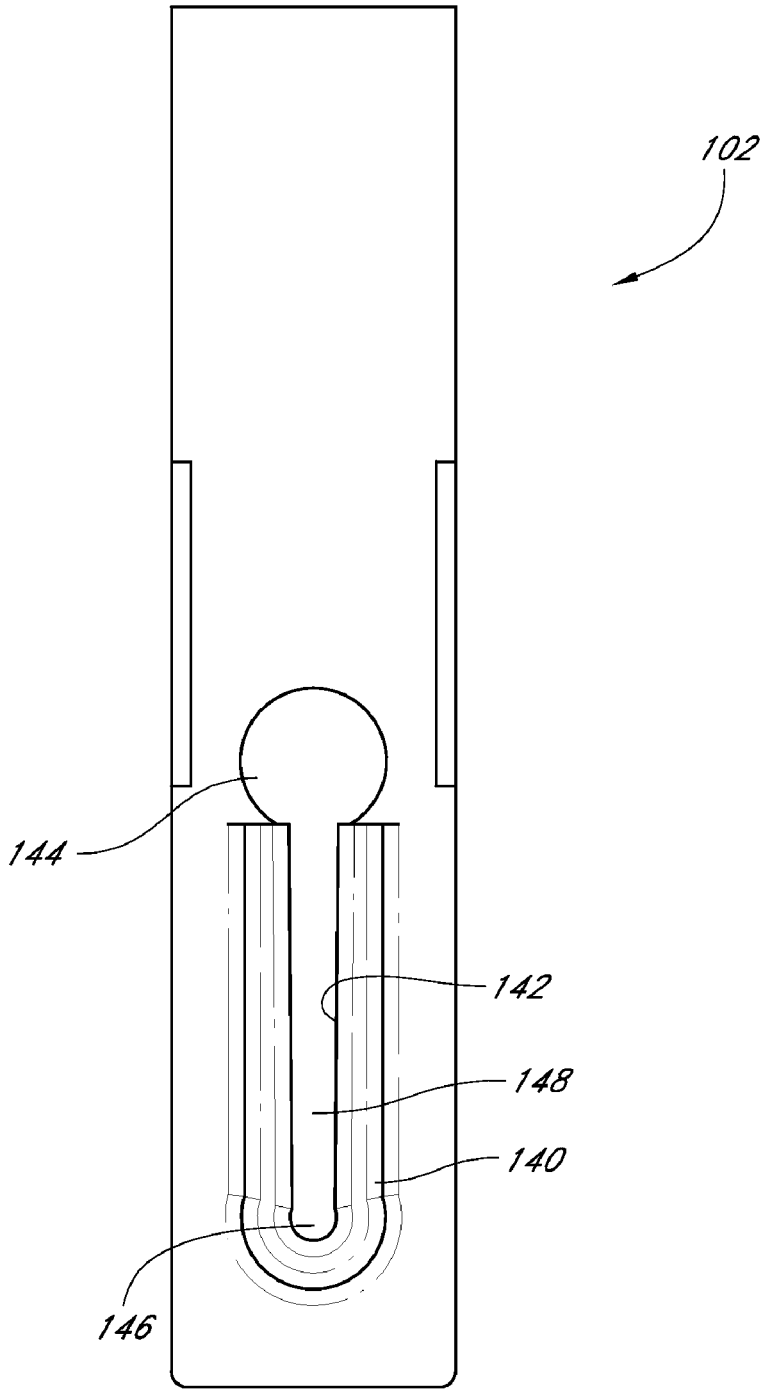
FIG. 7 is a top perspective view of a bracket of the spacer assembly shown in FIG. 5.

FIGS. 5-7 illustrate an embodiment of a spacer assembly 40 and various components thereof. The spacer assembly 40 can include an elongate member 100 and a bracket 102. The elongate member 100 can be pivotally coupled to the bracket 102. In other embodiments, the elongate member 100 can be rigidly attached to the bracket 102 or directly to an umbrella rib. Further, it is contemplated that the elongate member 100 and the bracket 102 can be formed from a continuous piece of material. In some embodiments, the elongate member 100 can be configured to deflect relative to the bracket 102.

In use, as described above, the spacer assembly 40 can be used to attach at least a portion of a panel 18 to the canopy support frame 30. For example, the elongate member 100 can be used to fit within a pocket or loop of material located along a lower (e.g., an under) portion of a panel 18. Thus, the lower portion of a panel 18 can be attached to the elongate members 100 of a series of spacer assemblies 40 in order to secure the lower portion of the panel 18 to the canopy support frame 30.

Additionally, the bracket 102 can be used to attach at least a portion of an upper portion of a different panel 18 to the spacer assembly 40. As illustrated in FIGS. 4A-B, the bracket can be configured to and include a slot into which a coupling mechanism of the panel 18 can be secured. These features will be described in greater detail below with respect to FIGS. 6 and 7.

It is also contemplated that the spacer assembly 40 can be configured to reduce the likelihood of or prevent catastrophic failure of the umbrella 10, e.g., breakage of or damage to the canopy 16 and/or the canopy support frame 30. As mentioned above, it is possible that during use, an object such as a tree branch, soccer ball, etc. may strike the canopy 16 of the umbrella 10, or that a strong wind may exert a load against the canopy 16. In such instances, the canopy 16 itself will tend to be stressed, and if inflexible, may tear or otherwise fail.

Furthermore, the canopy support frame 30 is often subjected to forces that can cause breakage or failure if the forces are great enough. Therefore, in accordance with an embodiment of at least one of the inventions described herein is the realization that the umbrella 10 can be protected from failure by incorporating a stress or force-reducing mechanism that allows the canopy 16 to be resiliently supported on the canopy support frame 30. Further, it is contemplated that the canopy 16 can be coupled to the canopy support frame 30 by a biasing mechanism.

For example, FIG. 6 illustrates a side cross-sectional view of the spacer assembly 40 shown in FIG. 5. In the illustrated embodiment, the spacer assembly 40 can include a biasing mechanism 118 that allows the elongate member 100 to pivot intermediate the extended position 110 and the loaded position 112. The elongate member 100 of the spacer assembly 40 is shown in solid lines in the extended position 110, and in dashed lines in a loaded position 112. The biasing mechanism 118 can include a spring having a coil of wire, but can also include a leaf spring, elastic devices, elastically deformable/compressible materials, etc. In such embodiments, the biasing mechanism allows the elongate member 100 to be elastically moved from the extended position 110 to the loaded position 112.

As shown in FIG. 6, the elongate member 100 can include a first end 120 and a second end 122. The first end 120 can be flexible, deflectable, or moveable relative to the bracket 102 of the spacer assembly 40. For example, the second end 122 can be pivotally attached to the bracket 102. As illustrated in FIG. 5, the second end 122 can attach to a pair of raised flanges 124 extending from the bracket 102. However, it is also contemplated that in some embodiments, as mentioned above, that the second end 122 can also be integrally formed with the bracket 102.

The second end 122 of the elongate member 100 can also include a motion-limiting protrusion 126. The protrusion 126 can be configured to stop rotation of the elongate member 100 past a certain degree of rotation. Thus, when the elongate member 100 is rebounding from the loaded position 112, the motion-limiting protrusion 126 can pivot downwardly until contacting the bracket 102. Once the protrusion 126 contacts the bracket 102, the pivotal motion of the elongate member 100 can be stopped. It is contemplated that the motion-limiting member 126 can be integrally formed with the elongate member 100. However, the motion-limiting member 126 can also be separately formed from the elongate member 100 and can interact with or engage the elongate member 100 in order to limit the motion thereof.

The bracket 102 can be configured to mount the spacer assembly 40 to the rib member 42. Accordingly, the bracket 102 can have a rib mounting surface 130 that can be configured to be coupled with a bracket engagement surface 131 of the rib 42. As illustrated, the rib mounting surface 130 can be generally planar; however, the rib mounting surface 130 can be sized to correspond to the shape and size of the rib member 42 in order to facilitate mounting and attachment thereto. For example, the bracket 102 can also include at least one side flange 132 and connector portion 134. The flange(s) 132 can conform to at least one side of the rib member 42 in order to facilitate attachment and coupling thereto. Further, the connector portion 134 can be an aperture, hole, or indented area that can mate with a corresponding protrusion or aperture of the rib member 42. Additionally, a connector such as a screw, bolt, or rivet, to name a few, can be used to interconnect the connector area 134 of the bracket 102 to the rib member 42.

Referring to FIGS. 5-6, some embodiments of the bracket 102 can also be configured to include a panel coupling mechanism 140. As described in relation to FIGS. 4A-B, the coupling mechanism 140 can be used to couple at least a portion of a panel 18 with the canopy support frame 30. FIGS. 4A-B illustrate an embodiment wherein an engaging portion of the panel, such as a rivet coupled to the panel, can be attached to a coupling mechanism of the spacer assembly 40.

In FIGS. 6 and 7, an embodiment of the coupling mechanism 140 is shown as including a slot 142 with an open end 144 and a closed end 146. As discussed above with respect to FIGS. 4A-B, the engaging portion of the panel can be received within the open end 144 of the slot 142 and can then be moved toward the closed end 146 of the slot 142. The motion of the engaging portion of the panel can generally be in the direction of the distal end 70 of the rib member 42. Accordingly, it is contemplated that when the umbrella 10 is in the closed position 12, the force of gravity exerted on the panel can tend to maintain the engaging portion of the panel at the closed end 146 of the slot 142.

In some embodiments, the slot 142 can also be formed to include a tapered section 148. The tapered section 148 can taper from wider near the open end 144 to narrower towards the closed end 146 thereof. As such, the tapered section 148 can be configured to engage the engagement member or portion of the panel. For example, as the engagement member or portion of the panel is moved toward the closed end 146, it can be progressively more tightly confined within the slot 142. In some embodiments, this tight confinement can approach that of a press-fit arrangement. In other embodiments, the slot 142 can include other features, such as teeth, deflectable members, etc. that provide one-way movement for the engagement member or portion of the panel within the slot 142.

Additionally, FIG. 6 illustrates that the coupling mechanism 140 can be of a generally uniform height. It is contemplated that the height thereof can also vary. Accordingly, the configuration of the coupling mechanism 140 can be variously configured relative to the engaging portion of the panel in order to ensure secure attachment thereof. Additionally, it is contemplated that the panels can be removably attached to the canopy support frame 30. The can be facilitated by configuring the engaging portion of the panel to be removably attachable to the slot 142 of the spacer assembly 40.

Figure 8:
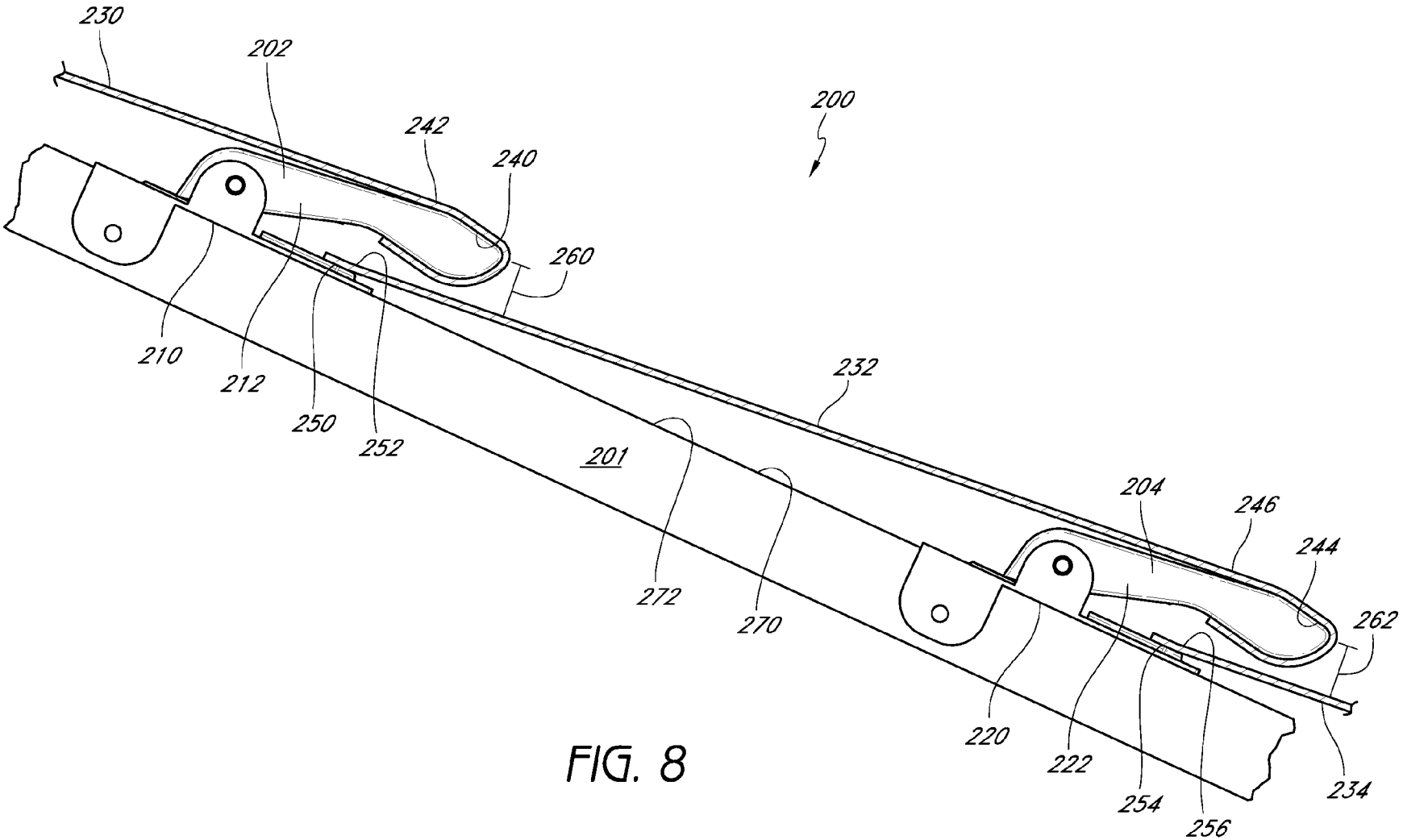
FIG. 8 is a side view of a rib member and canopy, according to an embodiment.

Referring to FIGS. 6-8, it is contemplated that the gaps between adjacent panels can be selectively modified to provide greater or lesser degrees of ventilation therethrough. As mentioned above, the configuration of the spacer assembly 40, and in particular, the orientation of the elongate member 100 relative to the bracket 102, can be generally manipulated to alter the amount of overlap of adjacent panels 18. It is contemplated that the degree of panel overlap can affect the amount of wind resistance created by the umbrella 10. In particular, larger gaps may reduce the amount of wind resistance. Therefore, in some embodiments, the length, height, and angular orientation of the components of the spacer assembly 40 can be modified such that the gaps intermediate adjacent panels are of a desired size.

For example, with reference to FIGS. 6 and 8, the amount of overlap can be modified by adjusting the length of the elongate member 100. Additionally, with reference to FIGS. 6-8, the size and location of the slot 142 on the bracket 102 can be modified to adjust the final position at which a lower panel attaches to the bracket, thereby modifying the amount of overlap between adjacent panels. Other such modifications can be implemented individually or collectively to adjust the size of the gaps.

Referring now to FIG. 8, a side cross-sectional view of a canopy assembly 200 is provided. This view also shows a side view of the rib member 201 and spacer assemblies 202, 204. The rib member 201 can have an upper spacer assembly 202 and a lower spacer assembly 204 corresponding to respective series of spacer assemblies disposed thereon. The upper spacer assembly 202 can include a bracket 210 and an elongate member 212, and the lower spacer assembly 204 can include a bracket 220 and an elongate member 222. The cross-sectional view of the canopy assembly 200 illustrates that the canopy 200 comprises an upper panel 230, an intermediate panel 232, and a lower panel 234.

The upper panel 230 can be attached to the elongate member 212 of the upper spacer assembly 202. In this regard, the upper panel 230 (as well as other panels of the canopy) can include a pocket 240 disposed along a lower end 242 thereof into which the elongate member 212 can be received. This is also illustrated with respect to the intermediate panel 232, wherein a pocket 244 disposed along a lower end 246 thereof receives the elongate member 222 of the lower spacer assembly 204. The pockets 240, 244 can be integrally formed with each respective panel 230, 232 from continuous pieces of material, or the pockets 240, 244 can be formed separately from the panels 230, 232 and later attached thereto. For ease of assembly, it is contemplated that the pockets used on a panel can be sized to removably receive the respective elongate members of corresponding spacer assemblies.

In addition, the intermediate panel 232 and the lower panel 234 are also illustrated as being attached to the respective ones of the upper and lower spacer assemblies 202, 204. The intermediate panel 232 can include an engagement member or portion 250 disposed along an upper end 252 thereof which can engage and be secured to the bracket 210 of the upper spacer assembly 202. Further, the lower panel 234 can include an engagement member or portion 254 disposed along an upper end 256 thereof which can engage and be secured to the bracket 220 of the lower spacer assembly 204.

In use, the spacer assemblies 202, 204 can maintain gaps 260, 262 between the panels 230, 232, 234 in order to allow venting of air intermediate the panels 230, 232, 234. Accordingly, the spacer assemblies 202, 204 can maintain the panels 230, 232, 234 in an angular relationship relative to the rib member 201 to separate the panels 230, 232, 234 from a plane 270 extending along a rib mounting surface 272 of the rib member 201. Further, in embodiments wherein the spacer assemblies 202, 204 include biasing mechanisms, the panels 230, 232, 234 can be resiliently loaded, thereby causing the elongate members 212, 222 to be displaced. When the load is removed, the elongate members 212, 222 can return to the extended position shown in FIG. 8.

In a first preferred embodiment, an umbrella is provided that comprises a canopy and a support structure upon which the canopy is supported. The canopy comprises a first panel and a second panel. The support structure can comprise a spacer configured to provide a gap separating the first and second panels to permit air to be vented across the canopy.

In such an embodiment, the spacer can be mounted to a top (or upper) side of a rib near a bottom edge of the first panel. Further, the spacer can be mounted to a top (or upper) side of a rib and is biased away from the rib. The spacer can also be biased to provide the gap at least when the umbrella is in the open position.

The spacer can be movable from a first position in which the first panel is separated from the second panel by a first distance to a second position in which the first panel is separated from the second panel by a second distance greater than the first distance. In this regard, the spacer can be in the second position in the absence of a force exceeding the weight of the first panel. Additionally, the spacer can move toward the first position in response to a load exceeding the weight of the first panel (e.g., a high wind load or impact).

The spacer can include an elongate member comprising a first end and a second end, wherein the first end is coupled with a rib of the support structure and the second end is moveable from a first position to a second position. In some embodiments, the first position is between the second position and a surface of the rib. The spacer can be pivotable relative to the rib, and in some embodiments, can be pivotally coupled with the rib. For example, in some embodiments a bracket can interconnect the spacer and the rib. In some embodiments, the umbrella can further comprise a resilient member configured to bias the elongate member toward the second position.

In another preferred embodiment, a fixture for connecting a first canopy panel and a second canopy panel to a support structure of an umbrella is provided. The support structure can include a rib. The fixture can comprise a bracket, an elongate member, an attachment mechanism, and a coupling mechanism. The bracket can have a rib mounting surface configured to be coupled with the rib. The elongate member can have a first end and a second end. The first end can be pivotally coupled with the bracket and the second end can be moveable relative to the bracket. The second end can have a panel engagement surface facing away from the bracket. The panel engagement surface can be capable of applying a force to the first panel (e.g., to an underside surface of the panel).

The attachment mechanism can be operative to attach the elongate member to the bracket such that at least the panel engagement surface is separated from a plane extending along the rib mounting surface. This separation can create a gap, which can be large enough to permit wind loads to be vented through a canopy assembly. The coupling mechanism can couple an upper portion of the second canopy panel to the rib.

In some embodiments, the fixture can further include a biasing means that biases the elongate member relative to the bracket such that at least the panel engagement surface is separated from a plane extending along the rib mounting surface. In such an embodiment, the biasing means can include a spring or any other resilient member, such as those disclosed herein.

The coupling mechanism can include a slot. The slot can include a u-shaped channel configured to receive an engagement member or portion of a panel. The engagement member of the panel can include a rivet or button fastener that can be coupled with an upper portion of the second canopy panel.

The bracket can include an elongate portion including the coupling means. The bracket can include a flange for coupling the fixture to a side surface of a rib of the support structure.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella comprising:

a canopy comprising a first panel and a second panel; and a support structure upon which the canopy is supported, the support structure comprising a rib and a spacer coupled to the rib, the spacer comprising a bracket and an elongate member, the bracket defining a slot, the spacer being configured for biasing the first panel away from the rib of the support structure, wherein an upper section of the first panel is attached relative to the rib and a lower section of the first panel is attached to the elongate member of the spacer, and wherein an upper section of the second panel comprises an engagement member that is removably attached to the bracket of the spacer by sliding the engagement member into the slot of the bracket underneath the lower section of the first panel, the spacer separating the lower section of the first panel from the upper section of the second panel to provide a gap separating the first and second panels to permit air to be vented through the canopy.

2. The umbrella of claim 1, wherein the spacer is mounted to a top side of the rib near a bottom edge of the first panel.

3. The umbrella of claim 1, wherein the spacer is mounted to a top side of the rib and is biased away from the rib.

4. The umbrella of claim 1, wherein the spacer is biased to provide the gap at least when the umbrella is in the open position.

5. The umbrella of claim 1, wherein the spacer is movable from a first position in which the first panel is separated from the second panel by a first distance to a second position in which the first panel is separated from the second panel by a second distance greater than the first distance.

6. The umbrella of claim 5, wherein the spacer is in the first position in the absence of a force exceeding the weight of the first panel.

7. The umbrella of claim 5, wherein the spacer moves toward the second position in response to a load exceeding the weight of the first panel.

8. The umbrella of claim 1, wherein the spacer is an elongate member comprising a first end and a second end, wherein the first end is coupled with the rib of the support structure and the second end is moveable from a first position to a second position, the first position being between the second position and a surface of the rib.

9. The umbrella of claim 8, wherein the spacer is pivotally coupled with the rib.

10. The umbrella of claim 9, further comprising a resilient member configured to bias the elongate member toward the second position.

11. The umbrella of claim 8, wherein the first position is a closed position and the second position is an open position.

12. The umbrella of claim 1, wherein the engagement member is a protrusion.

13. An umbrella comprising:

a support pole having a top;

a plurality of ribs extending from adjacent the top of the pole, the ribs having free ends and being movable to open and close the umbrella;

a canopy, formed by a plurality of panels, the panels having gaps between them and between at least one pair of adjacent ribs, so as to form a series of such gaps in the direction from the top of the pole to the free ends of the ribs;

a plurality of spacers mounted to at least some of the ribs, the spacers each comprising a bracket and an elongate member, the elongate member of the each spacer being coupled to lower sections of the panels, the bracket forming coupling mechanisms with at least some of the panels to removably couple at least some of the panels with the brackets of the spacers, the coupling mechanisms each comprising a slot and an engagement member that can be received in the slot, the spacers being configured to bear against the panels when the umbrella is open, so as to open the gaps and allow air to flow through the umbrella.

14. The umbrella of claim 13, wherein the spacers are mounted to each rib.

15. The umbrella of claim 13, wherein the number of spacers on each rib correspond to the number of gaps.

16. The umbrella of claim 13, wherein the spacers comprise a mechanism for attaching the panels.

17. The umbrella of claim 13, wherein the spacers are biased away from the ribs.

18. The umbrella of claim 13, wherein the gaps extend substantially the distance between adjacent ribs.

19. The umbrella of claim 13, wherein there are 5 gaps between each pair of adjacent ribs.

20. The umbrella of claim 13, wherein there are 4 gaps between each pair of adjacent ribs.

21. The umbrella of claim 13, wherein the spacers are configured to bear against a lower portion of a superior panel when the umbrella is open.

22. The umbrella of claim 13, wherein the spacers attach an upper portion of an inferior panel relative to the respective rib when the umbrella is open.

23. The umbrella of claim 13, wherein the engagement members are protrusions.

24. The umbrella of claim 13, wherein each coupling mechanism is configured such that the slot is formed on the bracket and the engagement member is attached to the panel.

25. An umbrella comprising:

a canopy comprising first, second, and third panels; and a support structure upon which the canopy is supported, the support structure comprising a plurality of ribs and at least first and second spacers each comprising a bracket and an elongate member being pivotally mounted to the bracket;

wherein an upper portion of the first panel is attached relative to a rib and a lower portion of the first panel is attached to the elongate member of the first spacer to provide a gap separating the lower portion of the first panel from the rib, and wherein an upper portion of the second panel forms a first coupling mechanism with the bracket of the first spacer, the first coupling mechanism comprising a first slot and a first engagement member that can be coupled to the first slot, a lower portion of the second panel being attached to the elongate member of the second spacer to provide a gap separating a lower portion of the second panel from the rib, and wherein an upper portion of the third panel forms a second coupling mechanism with the bracket of the second spacer, the second coupling mechanism comprising a second slot and a second engagement member that can be coupled to the second slot, the first and second panels being spaced to permit air to be vented through the canopy.

26. The umbrella of claim 25, wherein the first and second spacers are biased between extended and retracted positions relative to the ribs for permitting flexibility of lower portions of the first and second panels relative to the ribs.

27. The umbrella of claim 25, wherein the first, second, and third panels are each formed in a generally circular configuration.

28. The umbrella of claim 25, wherein the first and second engagement members are protrusions.

29. The umbrella of claim 25, wherein each of the first and second coupling mechanisms is configured such that the first and second slots are formed on the bracket, and the first and second engagement members are attached to the panel.

* * * * *

UNITED STATES PATENT AND TRADEMARK OFFICE

CERTIFICATE OF CORRECTION

PATENT NO. : 8,020,572 B2
APPLICATION NO. : 12/208299
DATED : September 20, 2011
INVENTOR(S) : Oliver Joen-an Ma It is certified that error appears in the above-identified patent and that said Letters Patent is hereby corrected as shown below:

At column 2, Line 38, please change “at lease” to --at least--.

Signed and Sealed this
Fifth Day of June, 2012

David J. Kappos

David J. Kappos
*Director of the United States Patent and Trademark Office*